US010753085B2

(12) United States Patent
Privan

(10) Patent No.: US 10,753,085 B2
(45) Date of Patent: Aug. 25, 2020

(54) CURTAIN WALL DRAIN OPENING APPARATUS

(71) Applicant: EXTAL Ltd., Mishor-Adumim (IL)

(72) Inventor: Michael Privan, Ramla (IL)

(73) Assignee: EXTAL LTD., Mishor-Adumim (IL)

( * ) Notice: Subject to any disclaimer, the term of this patent is extended or adjusted under 35 U.S.C. 154(b) by 0 days.

(21) Appl. No.: 16/373,727

(22) Filed: Apr. 3, 2019

(65) Prior Publication Data

US 2019/0309513 A1 Oct. 10, 2019

Related U.S. Application Data

(60) Provisional application No. 62/652,584, filed on Apr. 4, 2018.

(51) Int. Cl.
*E04B 2/88* (2006.01)

(52) U.S. Cl.
CPC ..... *E04B 2/88* (2013.01)

(58) Field of Classification Search
CPC . E04B 2/88; E06B 3/5427; E06B 7/14; E06B 2007/145; E06B 3/00
See application file for complete search history.

(56) References Cited

U.S. PATENT DOCUMENTS

| | | | | |
|---|---|---|---|---|
| 4,691,487 A * | 9/1987 | Kessler | E06B 7/14 | 137/527.8 |
| 2002/0029535 A1* | 3/2002 | Loper | E04F 17/00 | 52/302.1 |
| 2005/0138875 A1* | 6/2005 | Grunewald | E06B 7/14 | 52/302.1 |
| 2009/0120005 A1* | 5/2009 | Eckenswiller | E06B 7/14 | 49/408 |
| 2013/0118101 A1* | 5/2013 | Mitchell | E06B 7/14 | 52/209 |
| 2014/0041326 A1* | 2/2014 | Kadavy | E06B 7/14 | 52/209 |
| 2017/0198476 A1* | 7/2017 | Spannbauer | E06B 7/14 | |

* cited by examiner

*Primary Examiner* — Patrick J Maestri
(74) *Attorney, Agent, or Firm* — Roach, Brown, McCarthy & Gruber, P.C.

(57) ABSTRACT

Curtain wall based drain opening apparatus comprises a drainage element extending outwardly from, and in fluid communication with, a concealed horizontal water flow channel associated with a stationary first frame element of an inwardly pivotable window assembly and adapted to receive infiltrated water, wherein the drainage element passes through a second frame element which is laterally spaced from two adjacent fixed panels of a curtain wall and is exposed to atmospheric air.

18 Claims, 8 Drawing Sheets

Detail C

CURTAIN WALL DRAIN OPENING APPARATUS

FIELD OF THE INVENTION

The present invention relates to the field of building structures. More particularly, the invention relates to drain opening apparatus used in conjunction with a curtain wall with an inwardly openable window, embedded in the curtain wall.

BACKGROUND OF THE INVENTION

A curtain wall, which is generally associated with a multi-story building, is a non-structural, outer covering generally made of lightweight materials that is attached from the outside of a building and transfers lateral wind loads to a main building structure. A curtain wall is designed to span multiple floors, and its frame is typically infilled with a plurality of glass panels to provide a building exterior with an appearance of continuous panels from the top to bottom.

Curtain walls generally suffer from water infiltration, particularly wind driven rain as a result of the high wind speeds prevalent at upper floors, due to the curtain wall structure and the presence of inwardly openable windows. Many buildings deteriorate unacceptably as a result of the water infiltration.

It is an object of the present invention to provide drain opening apparatus to prevent water infiltration through vertically spaced panels of a curtain wall with an inwardly openable window, embedded in the curtain wall.

It is an additional object of the present invention to provide curtain wall drain opening apparatus that does not comprise the structural integrity and appearance of the infilled glass panels.

Other objects and advantages of the invention will become apparent as the description proceeds.

SUMMARY OF THE INVENTION

Curtain wall based drain opening apparatus comprises a drainage element extending outwardly from, and in fluid communication with, a concealed horizontal water flow channel associated with a stationary first frame element of an inwardly pivotable window assembly and adapted to receive infiltrated water, wherein said drainage element passes through a second frame element which is laterally spaced from two adjacent fixed panels of a curtain wall and is exposed to atmospheric air.

A curtain wall assembly comprises the drain opening apparatus.

As referred to herein, "outwardly" is in the direction of a fixed panel of the curtain wall, and "inwardly" is in the direction away from a fixed panel and towards an interior space of the building to which the curtain wall is attached. "Laterally" means in a direction between adjacent fixed panels of the same row of the curtain wall.

In one aspect, the drainage element is of a labyrinth type, such as configured with a horizontal segment thereof extending outwardly from the water flow channel, a vertical segment extending downwardly from, and in fluid communication with, an outward end of said segment extending outwardly from the water flow channel, and an additional horizontal segment extending outwardly from, and in fluid communication with, a bottom end of said vertical segment so as to be exposed to atmospheric air.

The vertical segment has a height that is longer than its width. For example, a ratio of height to width of the vertical segment ranges from 1.3 to 2.

In one aspect, the drainage element has a uniform cross section, being entirely horizontally oriented or configured with a slight downward incline to urge gravitation-caused flow of the infiltrated water.

In one aspect, the drain opening further comprises sealing material applied to the drainage element and to a third frame element positioned between adjacent fixed window panels. The third frame element may be a flange surrounding a corresponding fixed window panel, and the second frame element may be inwardly spaced relative to the third frame element. The sealing material may have a prefabricated configuration that is complementary to a shape of the drainage element.

In one aspect, the drain opening apparatus further comprises securement apparatus for securing the drainage element to the second frame element without appreciably blocking an aperture formed in the second frame element through which the infiltrated water is drainable.

A curtain wall assembly configured with a plurality of fixed window panels and a plurality of pivotable window panels interspersed among the plurality of fixed window panels comprises a concealed horizontal water flow channel provided below an engagement region between a sash frame of one of the pivotable window panels and a vertical frame element which is laterally spaced from two of the fixed window panels which are adjacent to each other, said water flow channel adapted to receive ingress of water infiltrating through said engagement region; and a drainage element passing through and extending outwardly from said frame element, and in fluid communication with said water flow channel.

As referred to herein, the "engagement region" through which water is able to infiltrate means a designed engagement region between a sash frame and a vertical frame element when the sash frame and the corresponding pivotable window panel are set to a closed position, generally, but not necessarily, by means of an attached flexible element such as a sealing element, and also a region between the sash frame and the vertical frame element when the sash frame is set to a closed position but a small clearance develops due to an unintentional variation in a dimension of a curtain wall assembly element, for example as a result of deterioration, which is not in compliance with an accepted tolerance, due to a deficient closing operation, or due to lack of an attached flexible element.

In one aspect, the water flow channel is of a limited length and laterally extends between the two fixed window panels which are adjacent to each other.

In one aspect, one of the drainage elements is in fluid communication with the water flow channel at each lateral end thereof.

In one aspect, the water flow channel is integrally formed with a stationary frame member associated with the sash frame.

In one aspect, the frame element through which the drainage element passes is a water deflector vertically extending from the stationary frame member, said water deflector being used to mitigate ingress of water through the engagement region into a zone between the stationary frame member and the sash frame.

In one aspect, the curtain wall assembly further comprises a sealing element which is coupled to an upper surface of the stationary frame member and is configured to be in abutting and sealing relation with an upper edge of the water flow channel and with a cooperating horizontal surface of the sash frame when set to a closed position, said sealing element delimiting an inner region of the zone between the stationary frame member and the sash frame through which the infiltrating water is introducible.

DETAILED DESCRIPTION THE INVENTION

The drain opening apparatus of the present invention is adapted for use with the type of curtain wall assembly that has pivotable windows, generally inwardly openable windows, which are interspersed among fixed windows. As water infiltration into the curtain wall assembly is anticipated through an engagement region between a vertical frame element associated with a fixed glass panel and a frame associated with a pivoting glass panel (hereinafter referred to as a "sash frame"), a horizontal water flow channel for receiving the infiltrated water is provided below the engagement region for each corresponding pair of vertically adjacent fixed and pivoting glass panels.

Drainage of water that has collected in a horizontal water flow channel is a major concern to building planners, who are interested in minimizing condensation formation caused by a temperature differential between an interior space and a glass panel. Condensation will lead to the deterioration of curtain wall insulation and to corrosion of steel parts provided in the curtain wall assembly.

Building planners, on the other hand, are faced with the conflicting requirement of maximizing the window-to-wall ratio of the curtain wall assembly, to improve its esthetic appearance. One contributing factor that promotes the esthetic appearance of the curtain wall assembly is the ability to display continuous rows of substantially aligned glass panels. Accordingly, when this factor is combined with requirement of maximizing the window-to-wall ratio, leading to a minimal vertical gap between adjacent rows of glass panels, it therefore follows that the horizontal water flow channel is invariably covered, usually by a glass panel. Without provision of the drain opening apparatus of the present invention, the only way that the water flow channel would be able to be drained is by boring an unappealing drainage hole through one of the glass panels that would considerably weaken the structural integrity of the glass panel.

To ensure proper drainage of the water collected in the horizontal water flow channel without compromising the structural integrity and esthetic appearance of the glass panels of the curtain wall assembly, drain opening apparatus mounted in a gap between laterally adjacent fixed glass panels of the curtain wall assembly is advantageously provided to be in fluid communication with the horizontal water flow channel and to be exposed to atmospheric air. This gap is a region that is devoid of a glass panel, but generally provided with a frame element, such as a flange surrounding the fixed glass panel.

Figure 1:
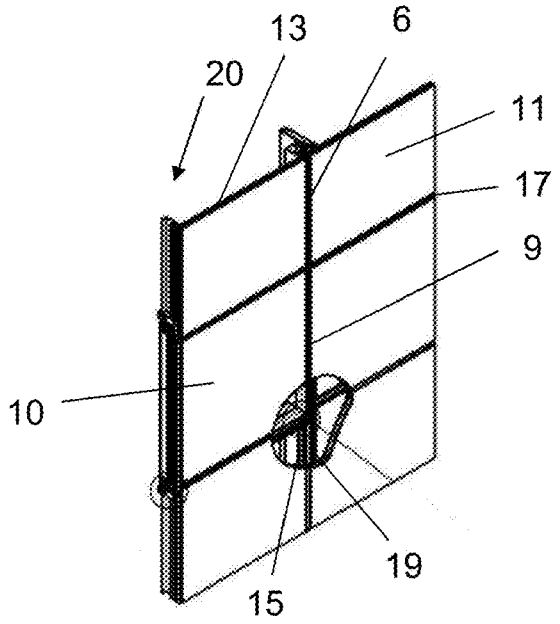
FIG. 1 is a perspective view from the front of a portion of a curtain wall assembly, showing a fragmented region thereof.
Figure 2:
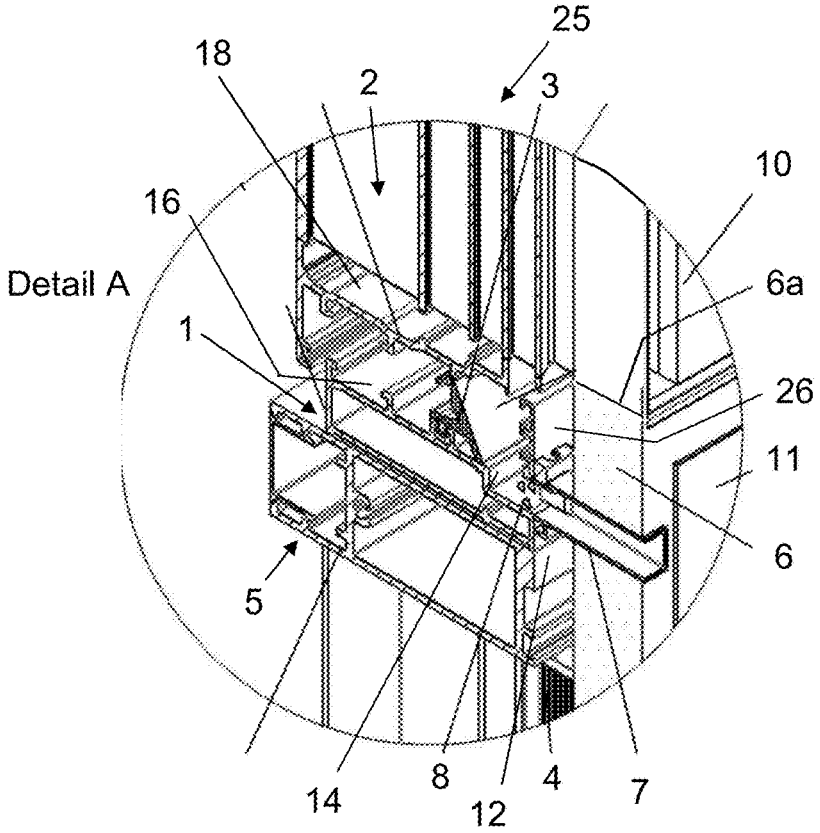
FIG. 2 is an enlargement of Detail A of FIG. 1, showing a window assembly as well as an embodiment of a drainage element in a vertically sectioned perspective view from the side.

One embodiment of the structure of curtain wall based drain opening apparatus is illustrated in FIGS. 1 and 2.

A portion of curtain wall assembly 20 is shown in FIG. 1, indicating a plurality of fixed glass panels 11 associated with the curtain wall assembly and a glass panel 10 associated with an inwardly openable pivoting window assembly that is interspersed among the fixed panels 11.

The upper edge 13 of all glass panels in a given row consisting entirely of fixed glass panels is at a common height. Likewise, the upper edge 17 of all glass panels in a given row consisting of both a pivoting glass panel 10 and fixed glass panels 11 is at a common height. A silicone sealing layer 6 is adhesively applied to all surfaces within the gap between adjacent fixed panels 11, for example over vertical and horizontal recessed joints interfacing the fixed panels to produce a flush finish. An interspace 9 between a side edge of a glass panel 10 of an inwardly openable pivoting window assembly and an adjacent side edge of a fixed glass panel 11 is devoid of a silicone sealing layer, to permit pivoting of the window assembly without interference. A fragmented portion of curtain wall assembly 20 reveals a frame element 1 associated with the pivoting window assembly and two abutting, vertically extending frame elements 15 and 19 of two laterally adjacent fixed glass panels 11, respectively, which are positioned in the gap between the fixed glass panels.

FIG. 2 illustrates window assembly 25 when set to a closed position. Window assembly 25 comprises a stationary frame element 1 connected to, for example overlying in accordance with the illustrated orientation, a horizontal curtain wall beam 5, which extends between two mullions 4 of curtain wall 20, and sash frame 2 adapted to pivot inwardly about a vertical axis. Pivotable glass panel 10 is mounted on outer surfaces of sash frame 2, and is vertically spaced from fixed glass panel 11. A vertically oriented water deflector 26 proximally extends, i.e. in a direction towards pivotable glass panel 10, from an outer portion 12 of curtain wall beam 5, and is used to mitigate ingress of water into a zone between frame element 1 and sash frame 2.

Figure 4:
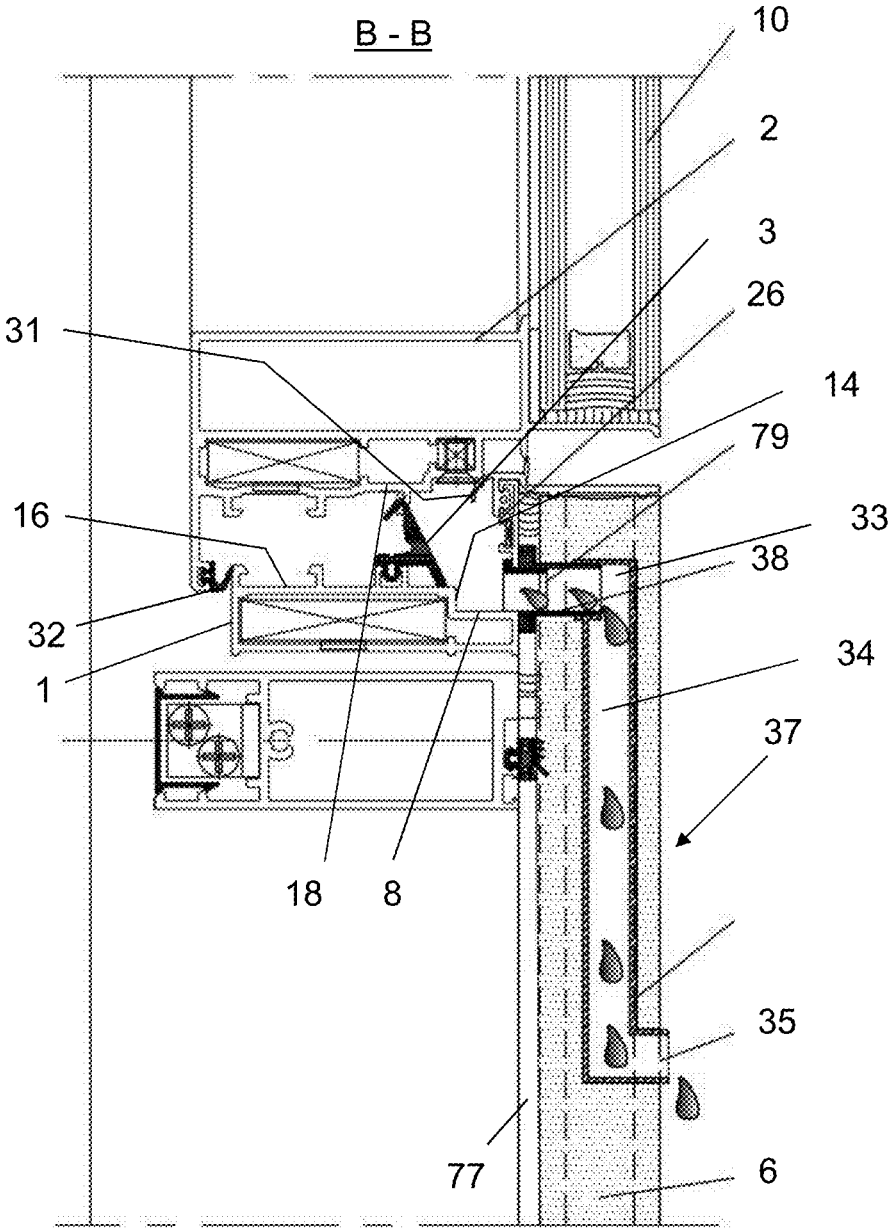
FIG. 4 is a cross sectional view of the curtain wall assembly of FIG. 3, cut along plane B-B of FIG. 3 and showing another embodiment of a drainage element.

When sash frame 2 is in the closed position, a proximal portion of water deflector 26 is in abutment with a distal, i.e. towards fixed glass panel 11, and outer portion of sash frame 2, for example sealing element 31 of FIG. 4, and an inward portion of frame element 1 is in abutment with an appendage distally protruding from sash frame 2, for example sealing element 32 of FIG. 4.

Since the engagement between water deflector 26 and sash frame 2 is unsealed or is provided with an imperfect seal, for example the weatherstrip seal 31 shown in FIG. 4 or any other flexible sealing element, which is attached to a distal and outer portion of sash frame 2 or alternatively to water deflector 26, there is a chance of water infiltration therebetween. A stationary, horizontal water flow channel 8 adapted to receive infiltrated water, if any, is formed integrally with an outer region 14 of frame 1, such that the lowermost surface of channel 8 is located below an upper horizontal surface 16 of frame 1. A sealing element 3, e.g. oblique, coupled to the entire length of the upper surface 16 of frame 1 is adapted to be in abutting and sealing relation with the upper edge of channel 8 and with a cooperating horizontal surface 18 of sash frame 2, to prevent additional wind and water infiltration.

To prevent overflow of the water received by channel 8, a drainage element 7 of uniform cross section, shown to be of rectangular cross section but which may also be tubular, is fixed to, and extends outwardly from, channel 8 while being in fluid communication therewith. An aperture may be formed in water deflector 26 to facilitate the protrusion of drainage element 7 therethrough.

To accommodate the presence of drainage element 7, silicone sealing layer 6 is applied around drainage element 7, or alternatively is applied to distal and proximal regions of drainage element 7, in addition to being adhesively applied to a frame element associated with each fixed glass panel 11. To facilitate its application, silicone sealing layer 6 may be prefabricated to assume a dedicated configuration that is complementary to the shape of drainage element 7. Silicone sealing layer 6 may be terminated at approximately a proximal region 6*a* that corresponds with the extreme proximal portion of water deflector 26 to enable uninhibited pivotal displacement of window assembly 25. The length of drainage element 7, or its protruding dimension from channel 8, is preferably such that its outer edge is flush with, or slightly recessed from the outer surface of silicone sealing layer 6. The silicone sealing layer 6 applied to drainage element 7 may be a vertical gasket or a horizontal gasket.

According to an alternative embodiment, no silicone sealing is applied into the spacing between adjacent fixed glass panels 11. In this case, sealing may be obtained by other means, such as composite beams with dedicated profiles. But still, the location of drainage element 7 is selected to be exactly within the vertical spacing between adjacent fixed glass panels 11. This is an important advantage of the present invention, since any other location would require forming a via-hole in the glass panel 11, to allow drainage element 7 to discharge water that has accumulated within channel 8.

Drainage element 7 exposed to atmospheric air facilitates discharge and evaporation of accumulated water within channel 8. Drainage element 7 may be entirely horizontally oriented, or, alternatively, may be configured with a slight downward incline to urge gravitation-caused flow.

Figure 3:
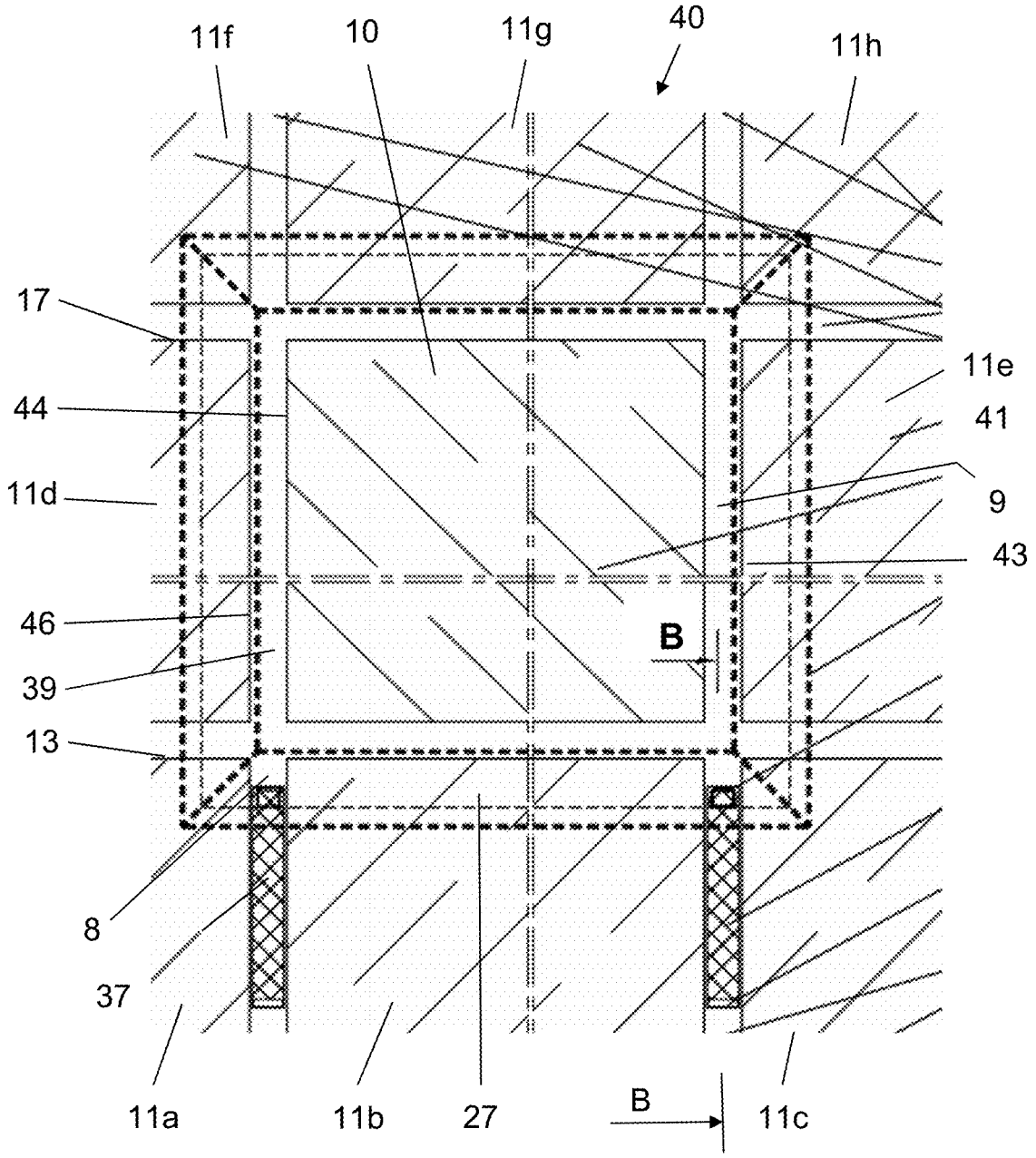
FIG. 3 is a front view of a portion of a curtain wall assembly according to another embodiment, indicating a flange surrounding an inwardly pivoting glass panel which is set to a closed position by dashed lines.
Figure 5:
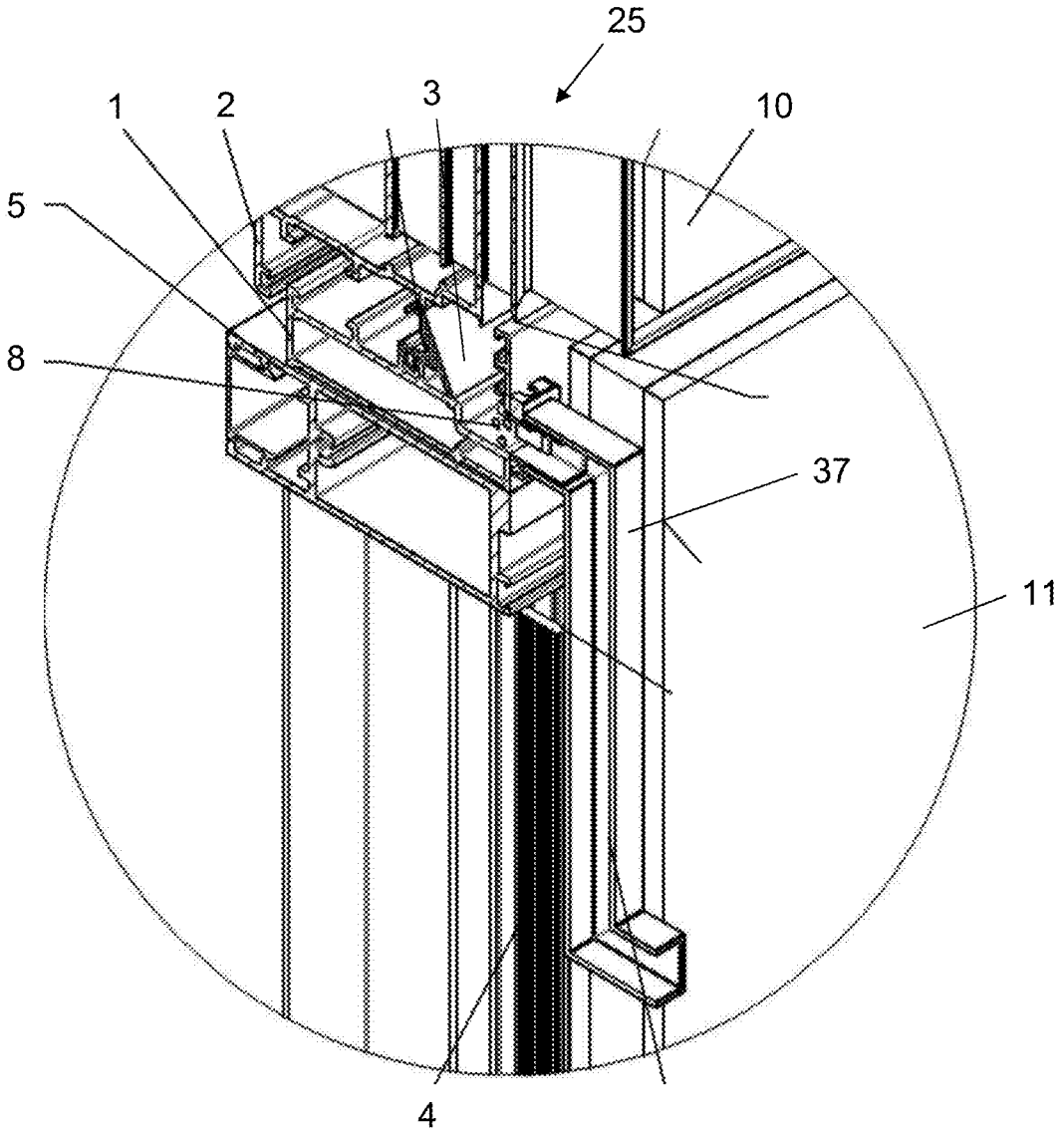
FIG. 5 is a vertically sectioned perspective view from the side of the drainage element as of the window assembly shown in FIG. 4.

Another embodiment of curtain wall based drain opening apparatus for use in conjunction with an inwardly pivoting window assembly 25 is illustrated in FIGS. 3-5.

A portion of curtain wall assembly 40 is shown in FIG. 3 when inwardly pivoting glass panel 10 is set to a closed position. The upper edge 13 of all glass panels in a given row consisting entirely of fixed glass panels, e.g. panels 11*a-c*, is at a common height. Likewise, the upper edge 17 of all glass panels in a given row consisting of both an inwardly pivoting glass panel 10 and fixed glass panels, e.g. panels 11*d* and 11*e*, is at a common height.

Fixed glass panel 11*b* is shown to be located directly below pivoting glass panel 10 such that the side edge 41 of panels 10 and 11*b* are aligned and the side edge 43 of panels 11*c* and 11*e* are aligned to define common interspace 9 between side edges 41 and 43. Likewise, the side edge 44 of panels 10 and 11*b* are aligned and the side edge 46 of panels 11*a* and 11*d* are aligned to define common interspace 39 between side edges 44 and 46. The rectangular flange 27 surrounding inwardly pivoting glass panel 10, which is indicated by dashed lines, is positioned inwardly to a portion of fixed panels 11*a-h*, when set to a closed position.

Horizontal water flow channel 8 adapted to receive infiltrated water, if any, that has infiltrated into curtain wall assembly 40 extends between fixed glass panels 11*a* and 11*c*. Since upper edge 13 of fixed glass panel 11*b* covers channel 8, the only way the channel can be drained without having to drill a drainage hole in fixed glass panel 11*b* is by providing drain opening apparatus 37 within each of interspaces 9 and 39, so as to be in fluid communication with water flow channel 8.

It will be appreciated that suitable drainage of the infiltrated water may be ensured by providing drain opening apparatus 37 within only one of the interspaces 9 and 39.

As shown in FIG. 4, drainage element 37 is of the labyrinth type, with a horizontal segment 33 thereof extending outwardly from horizontal water flow channel 8 such that the bottom surface 38 of segment 33 is coplanar with the bottom surface of channel 8, a vertical segment 34 which is embedded within silicone sealing layer 6 and extending downwardly from, and in fluid communication with, the outward end of segment 33, and an additional horizontal segment 35 extending outwardly from, and in fluid communication with, the bottom end of segment 34 so as to be exposed to atmospheric air. Upper segment 33 may be secured to water deflector 26, for example by securement apparatus 79 illustrated in more detail in FIGS. 9-10.

Water deflector 26, which may be provided with weatherstrip seal 31, may protrude inwardly from frame element 77 surrounding a fixed glass panel. Water deflector 26 may be connected to frame element 77 or formed integrally therewith. Alternatively, water deflector 26 may be coplanar with frame element 77.

The top surface of horizontal segment 33 may be slightly spaced vertically above upper horizontal surface 16 of stationary frame 1, so that any overflow from water flow channel 8 will be directed to segment 33. Oblique sealing element 3 is in sealing relation with the junction of vertical surface 14 of water flow channel 8, which is common to an outer region of frame 1, and surface 16 and with distal horizontal surface 18 of sash frame 2, and delimits zone Z within which the infiltration water is received while preventing inward flow of the infiltration water.

The labyrinth configuration of drainage element 37 assists in preventing the ingress of water, particularly precipitation such as rain which may be displaced upwardly by wind pressure, from segment 35 to segment 33. A vertical segment 34 having a height that is longer than its width, for example by a ratio ranging from 1.3-2, and generally having a minimum height of 10 cm, will resist the vertical rise of water therethrough. A large cross sectional area of segment 35 will also prevent the vertical rise of liquid within segment 34 as long as segment 35 is not completely filled with liquid.

The structure of curtain wall assembly 40, aside from drainage element 37, may be similar to curtain wall assembly 20, as shown in FIGS. 4 and 5.

Figure 6:
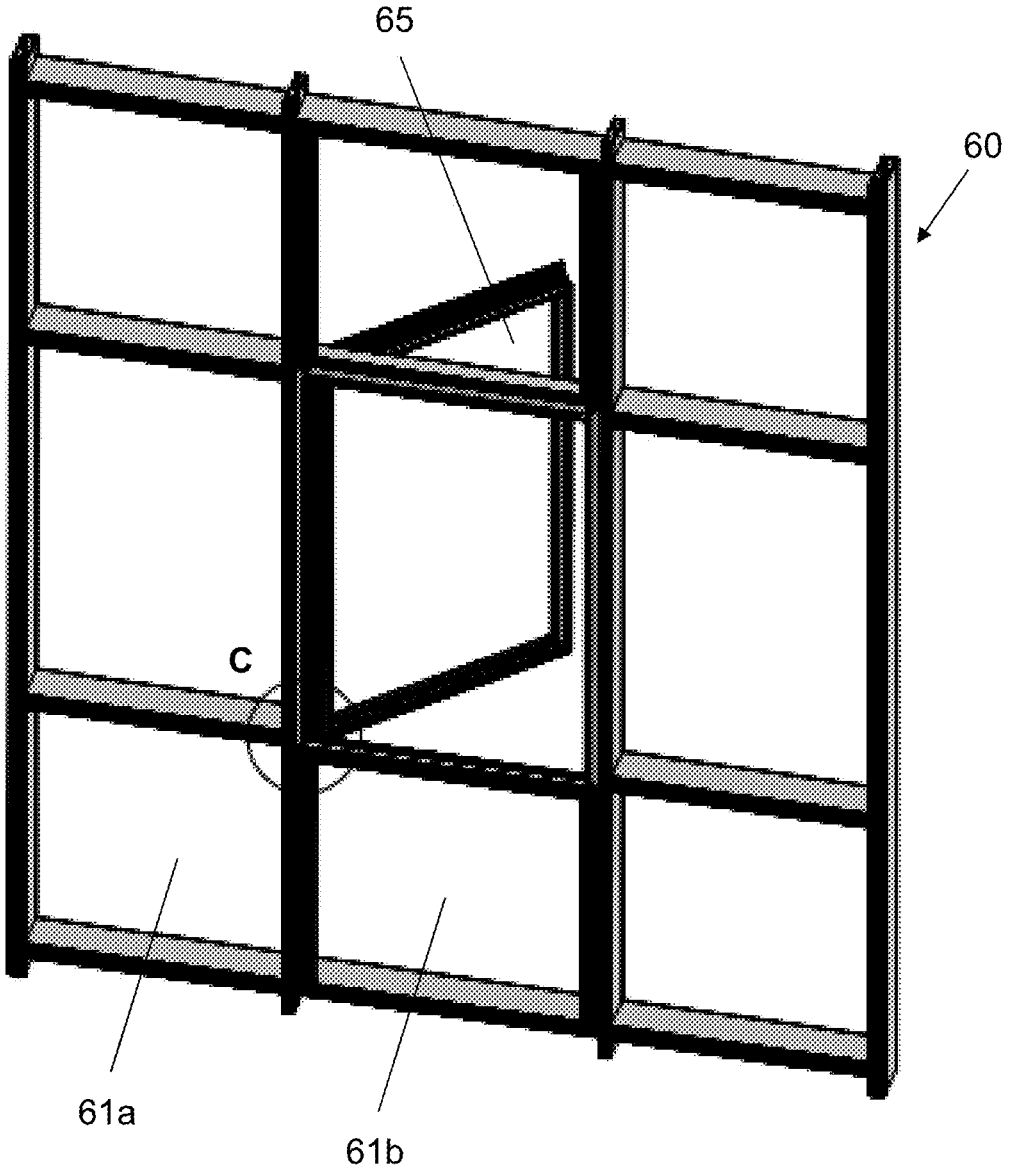
FIG. 6 is a perspective view from the front of a portion of a curtain wall assembly according to another embodiment, showing one of the inwardly pivoting glass panels when set to an opened position.
Figure 7:
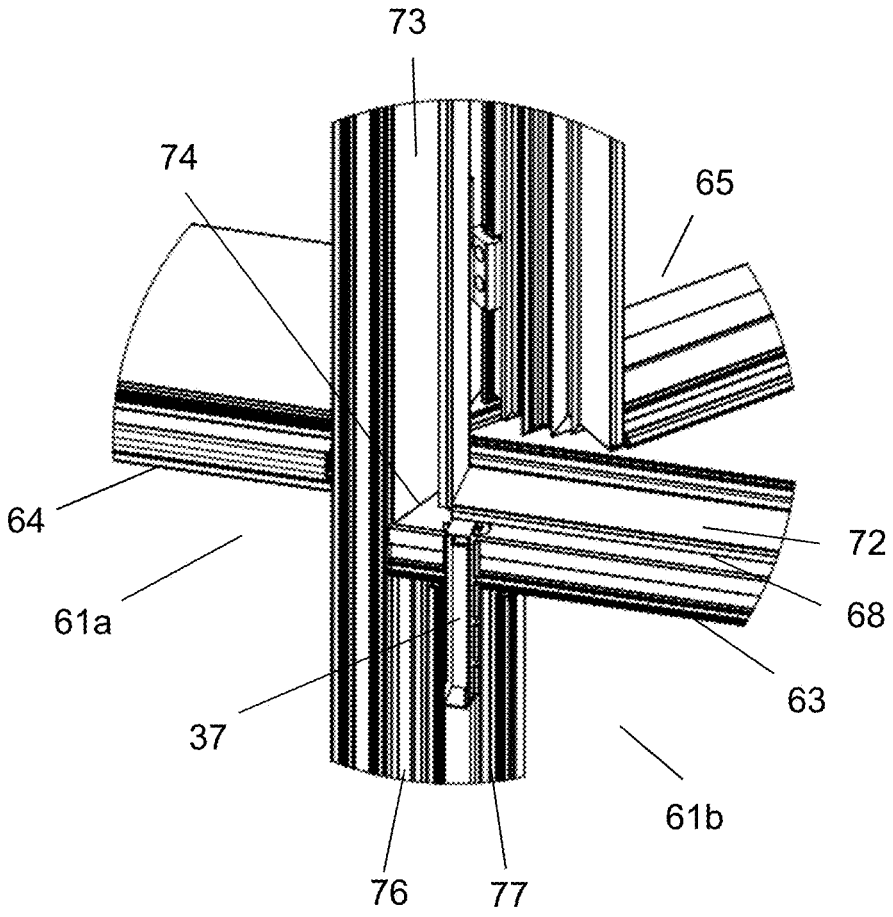
FIG. 7 is an enlargement of Detail C of FIG. 6.
Figure 8:
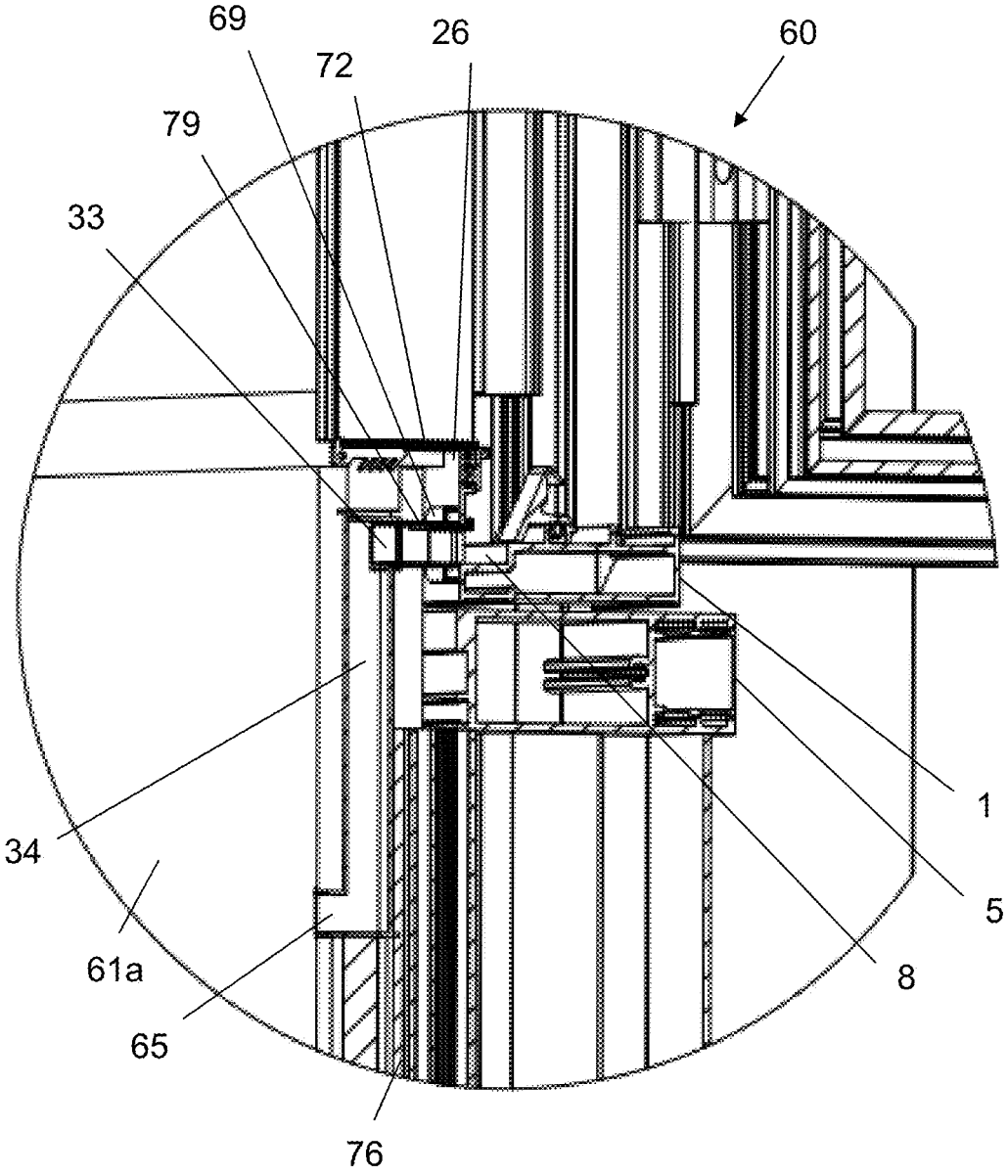
FIG. 8 a vertically sectioned perspective view from the side of the curtain wall assembly of FIG. 6.

FIGS. 6-8 illustrate a portion of curtain wall assembly 60 for accommodating inwardly pivoting glass panel 65 and drain opening apparatus 37 wherein the upper edge of the fixed glass panels of a given row are at a similar, but not at a common, height. For example as shown in FIG. 6, the upper edge 63 of the fixed glass panel 61*b* located directly below inwardly pivoting glass panel 65 is located slightly below the upper edge 64 of the fixed glass panel 61*a* located adjacent to panel 61*b*.

In this embodiment, apparatus of curtain wall assembly 60 shown in FIG. 8, including frame element 1 of the inwardly pivotable window assembly, water flow channel 8 formed integrally with an outer region of frame element 1, and curtain wall beam 5, is concealed by horizontal frame element 68 and by substantially horizontal cover element 72 connected to frame element 68, as shown in FIG. 7. Horizontal cover element 72 extends laterally to an interface 74 with vertical cover element 73 and obliquely and outwardly to a portion of upper horizontal segment 33 of labyrinth drainage element 37. In order to benefit from the good draining capabilities and good resistance to water infiltration provided by labyrinth drainage element 37 without detracting from the esthetic appearance of curtain wall assembly 60 by forming apertures in horizontal frame element 68 to enable discharge of the infiltrated water collected in the horizontal water flow channel or by drilling a hole in fixed glass panel 61*b* to accommodate the bottom segment of the drainage element, or without blocking a portion of fixed glass panel 61*b*, the labyrinth drainage element is advantageously positioned in the gap between fixed glass panels 61*a* and 61*b*.

FIGS. 7 and 8 illustrate labyrinth drainage element 37 as its upper segment 33 passes through an aperture 69 formed in water deflector 26 and is aligned with water flow channel 8, and its vertical segment 34 contacts and protrudes outwardly from one or both of the abutting frame elements 76 and 77 of fixed glass panels 61*a* and 61*b*, respectively. Securement apparatus 79 may be used for securing upper segment 33 to water deflector 26, or to any other frame element, aligned with water flow channel 8. Since the unrestrained vertical segment 34 is subject to significant movement due to wind derived forces that are prevalent at upper floors of a multi-story building, vertical segment 34 and bottom segment 35 of the labyrinth drainage element 37 are anchored by adhesively applying the silicone sealing layer thereto and to frame elements 76 and 77. Once applied, the silicone sealing layer may be flush with fixed glass panel 61*a* together with bottom segment 35, as illustrated. In addition to anchoring labyrinth drainage element 37, the silicone sealing layer also serves to seal the small clearance between frame elements 76 and 77.

Figure 9:
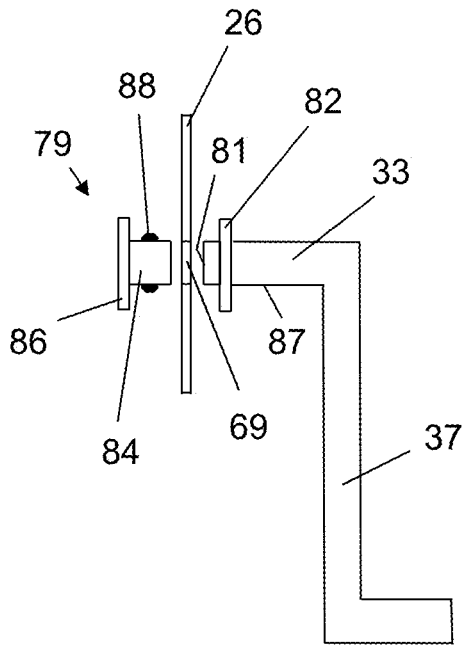
FIG. 9 is an exploded view of exemplary securement apparatus.
Figure 10:
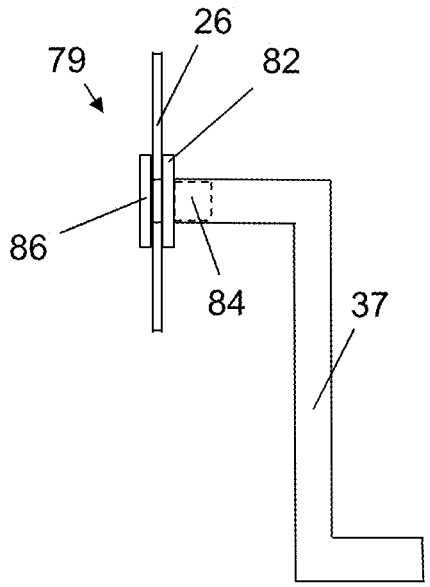
FIG. 10 is a cross sectional view of a drainage element when secured by the securement apparatus of FIG. 9.

FIGS. 9 and 10 illustrate an exemplary securement apparatus 79 for securing labyrinth drainage element 37 to water deflector 26, or to any other suitable frame element. The same securement apparatus can be using for securing drainage element 7 of FIG. 2.

As shown in FIG. 9, securement apparatus 79 comprises a flange 82 fixed to the outer periphery of upper segment 33 of labyrinth drainage element 37, while being slightly spaced from its terminal end 81 and without interfering with the interior of the upper segment. A hollow insert element 84 having the same cross section as upper segment 33, but of slightly smaller dimensions, is adapted to be in abutting relation with the inner wall 87 of the upper segment after being inserted therewithin. A flange 86 is fixed to the outer periphery of insert element 84 at its inner end, without interfering with the interior of the insert element.

Upper segment 33 of labyrinth drainage element 37 is first introduced through aperture 69 formed in water deflector 26 until flange 82 contacts water deflector 26. Then insert element 84 is also introduced through aperture 69 and through the interior of upper segment 33 until flange 86 contacts water deflector 26. Insert element 84 may be in frictional contact with inner wall 87 of upper segment 33 by means of one or more protrusions 88 provided at its outer surface.

FIG. 10 illustrates securement apparatus 79 while labyrinth drainage element 37 is secured to water deflector 26. Flanges 82 and 86 in contact with opposite sides of water deflector 26 are aligned with each other, and also may be connected to each other, such as by fasteners. The interior of both labyrinth drainage element 37 and insert element 84 is in fluid communication with the water flow channel.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. Curtain wall based drain opening apparatus, comprising a drainage element extending outwardly from, and in fluid communication with, a concealed horizontal water flow channel associated with a stationary first frame element of an inwardly pivotable window assembly and adapted to receive infiltrated water, wherein said drainage element passes through a second frame element which is laterally spaced from two adjacent fixed panels of a curtain wall and is exposed to atmospheric air.

2. The drain opening apparatus according to claim 1, wherein the drainage element is of a labyrinth type.

3. The drain opening apparatus according to claim 2, wherein the drainage element is configured with a horizontal segment thereof extending outwardly from the water flow channel, a vertical segment extending downwardly from, and in fluid communication with, an outward end of said segment extending outwardly from the water flow channel, and an additional horizontal segment extending outwardly from, and in fluid communication with, a bottom end of said vertical segment so as to be exposed to atmospheric air.

4. The drain opening apparatus according to claim 3, wherein the vertical segment has a height that is longer than its width.

5. The drain opening apparatus according to claim 4, wherein a ratio of height to width of the vertical segment ranges from 1.3 to 2.

6. The drain opening apparatus according to claim 1, wherein the drainage element has a uniform cross section.

7. The drain opening apparatus according to claim 6, wherein the drainage element is entirely horizontally oriented.

8. The drain opening apparatus according to claim 6, wherein the drainage element is configured with a slight downward incline to urge gravitation-caused flow of the infiltrated water.

9. The drain opening apparatus according to claim 1, further comprising sealing material applied to the drainage element and to a third frame element positioned between adjacent fixed window panels.

10. The drain opening apparatus according to claim 9, wherein the sealing material has a prefabricated configuration that is complementary to a shape of the drainage element.

11. The drain opening apparatus according to claim 1, further comprising securement apparatus for securing the drainage element to the second frame element without appreciably blocking an aperture formed in the second frame element through which the infiltrated water is drainable.

12. A curtain wall assembly, which comprises the drain opening apparatus according to claim 1.

13. A curtain wall assembly configured with a plurality of fixed window panels and a plurality of pivotable window panels interspersed among the plurality of fixed window panels, said curtain wall assembly comprising:

a) a concealed horizontal water flow channel provided below an engagement region between a sash frame of one of the pivotable window panels and a vertical frame element which is laterally spaced from two of the fixed window panels which are adjacent to each other, said water flow channel adapted to receive ingress of water infiltrating through said engagement region; and b) a drainage element passing through and extending outwardly from said frame element, and in fluid communication with said water flow channel.

14. The curtain wall assembly according to claim 13, wherein the water flow channel is of a limited length and laterally extends between the two fixed window panels which are adjacent to each other.

15. The curtain wall assembly according to claim 14, wherein one of the drainage elements is in fluid communication with the water flow channel at each lateral end thereof.

16. The curtain wall assembly according to claim 14, wherein the water flow channel is integrally formed with a stationary frame member associated with the sash frame.

17. The curtain wall assembly according to claim 16, wherein the frame element through which the drainage element passes is a water deflector vertically extending from the stationary frame member, said water deflector being used to mitigate ingress of water through the engagement region into a zone between the stationary frame member and the sash frame.

18. The curtain wall assembly according to claim 17, further comprising a sealing element which is coupled to an upper surface of the stationary frame member and is configured to be in abutting and sealing relation with an upper edge of the water flow channel and with a cooperating horizontal surface of the sash frame when set to a closed position, said sealing element delimiting an inner region of the zone between the stationary frame member and the sash frame through which the infiltrating water is introducible.

* * * * *